US005645271A

United States Patent [19]

Nunez

[11] Patent Number: 5,645,271

[45] Date of Patent: Jul. 8, 1997

[54] METAL FENCE POST WITH ADJUSTABLE RAIL MOUNTING

[76] Inventor: Marcos D. Nunez, 11309 Telechron Rd., Whittier, Calif. 90605

[21] Appl. No.: 272,551

[22] Filed: Jul. 11, 1994

[51] Int. Cl.[6] ..... E04H 17/16

[52] U.S. Cl. ..... 256/67; 256/65; 256/24; 256/DIG. 2; 256/DIG. 5

[58] Field of Search ..... 256/67, 65, 26, 256/24, DIG. 5, DIG. 2; 52/295, 298, 274, 126.4, 126.7

[56] References Cited

U.S. PATENT DOCUMENTS

| | | | |
|---|---|---|---|
| 895,297 | 8/1908 | Peter | 256/67 X |
| 2,835,475 | 5/1958 | Enghauser | 256/24 X |
| 3,304,683 | 2/1967 | Ferreira | 256/24 X |
| 3,471,129 | 10/1969 | Mpakarakes | 256/24 |
| 3,614,068 | 10/1971 | Koehl | 256/24 X |
| 3,942,763 | 3/1976 | Helterbrand | 256/65 X |
| 4,070,006 | 1/1978 | Storie | 256/24 X |
| 4,481,743 | 11/1984 | Jellen | 52/126.4 X |

*Primary Examiner*—Anthony Knight
*Attorney, Agent, or Firm*—Gary Appel, Esq.

[57] ABSTRACT

An adjustable fence post apparatus for rigid metal, e.g., wrought iron, fences comprises a rigid metal post having fixed to its lower end a base plate for detachably mounting the post to a mounting pad. A first pair of spaced apart upper and lower rails are detachably attached to a first side region of the post and a second pair of spaced apart upper and lower rails are detachably attached to a second side region of the post. The post comprises telescoping inner and outer metal sleeves which enable the first and second pairs of upper and lower fence rails to be attached to the post at different elevations and at different horizontal angles relative to one another and enables the elevation of the fence rails to be adjusted relative to the post mounting pad.

18 Claims, 5 Drawing Sheets

METAL FENCE POST WITH ADJUSTABLE RAIL MOUNTING

BACKGROUND OF THE INVENTION

1. Field of the Invention

The present invention relates generally to the field of fences, more particularly to metal fences, and still more particularly to metal fence posts used in the making of wrought iron fencing.

2. Background Discussion

It should, at this point, be understood that the term "wrought iron" fencing as used herein is to be broadly interpreted to describe rigid metal fencing, as opposed, for example, to flexible metal chain-link fencing or to concrete block, slump-stone, brick or wood fencing. As such, the term "wrought iron" is commonly used in the fencing trade and by many homeowners in a broad sense, and is so used herein, to describe any and all types of rigid metal fencing that may, for example, be constructed of extruded metal tubing and bars, and to other types of rigid metal fencing that may be constructed of cast iron or cast aluminum. Thus the term "wrought iron" as used herein is not to be construed as being restricted only to iron fencing or to iron fencing that is actually constructed by a wrought iron process.

Wrought iron (as defined above) fences are widely used for decorative and/or security purposes around homes, condominiums, apartments, estates and the like. An important advantages of wrought iron fencing is that the decorative and/or security functions are provided while views beyond the fences remain largely unrestricted. In fact, in many expensive hillside communities with view lots, the only type of fencing permitted by homeowner associations and/or restrictive covenants is wrought iron fencing so that the view from other lots is not restricted, as might be the case, for example, with concrete block or wooden fences, and to preserve an "upscale" appearance of the involved properties.

So called wrought iron fencing, however, usually requires on site fabrication—cutting and welding of the fence posts, rails and palings—to conform the fencing to lot size and ground contours, to skirt perimeter slopes, and to provide for gates and other openings in the fence. Consequently, such fencing tends to be quite costly, not only to construct initially but also to repair when sections of the fence become damaged.

Because of the above-mentioned shortcomings and problems associated with heretofore available wrought iron fencing and for other reasons, it is a principle objective of the present invention to provide wrought iron fencing utilizing adjustable metal or iron fence posts which enable at least most of the fencing to be prefabricated at a manufacturer's plant, thereby providing the benefits of mass production, uniform manufacturing practices and good product consistency and quality, all at a cost that is lower than the cost of all on-site fabrication of wrought iron fences.

SUMMARY OF THE INVENTION

In accordance with the present invention, an adjustable metal fence post apparatus for wrought iron (i.e., rigid metal) fences comprises a rigid metal, for example, iron, post having fixed to a lower end region thereof a base plate configured for enabling the post to be detachably attached to a mounting pad, such as a concrete pad set in the ground or to another post mounting surface.

Included in the apparatus are first means for detachably attaching a first pair of vertically spaced apart upper and lower fence rails to a first side region of the post and second means for detachably attaching a second pair of vertically spaced apart upper and lower fence rails to a second side region of the post.

One of these first and second attaching means are configured for enabling one of the first and second pairs of fence rails to be detachably attached to the post at one or more elevated positions that are different from the elevated attachment position of the other one of the two pairs of upper and lower fence rails. The two pairs of fence rails can thereby be attached to the post in a vertically staggered relationship relative to one another, as may, for example, be needed to accommodate irregular terrain on which the fencing is installed. Preferably, the apparatus also includes means for leveling the fence post base plate in a horizontal plane (i.e., with the fence post vertical) when the base plate is attached to a mounting pad or other surface that is not perfectly horizontal.

In accordance with a preferred embodiment of the invention, the post includes an elongate inner sleeve and an elongate outer sleeve, the outer sleeve being slidably mounted or disposed around the outside of the inner sleeve. The first attaching means are then configured for detachably attaching the first pair of upper and lower fence rails, which comprise a first section of fencing, to the outer sleeve and at least the upper rail of the second pair of upper and lower fence rails, which comprise a second section of fencing, to the outer sleeve.

For some applications in which the elevation of the first and second pair of rails is to be vertically offset from one another by more than a small amount, the outer sleeve may comprise a longer upper section and a short lower section, each of which may be separately detachably attached to the inner sleeve. In this case when the second pair of upper and lower fence rails is to be positioned at an elevation significantly lower than that of the first pair of upper and lower rails, the lower section of the outer sleeve is mounted to the inner sleeve below the lower rail of the first pair of upper and lower rails (which is attached to the upper section of the outer sleeve near its lower end) and spaced below the lower end of the upper section of the outer sleeve. The lower fence rail of the second pair of upper and lower rails is then detachably mounted to the lower section of the outer sleeve.

When both the first and second pairs of upper and lower fence rails are to be attached to the fence post at or at about at the same elevation, the lower section of the outer sleeve is not needed, both pairs of upper and lower rails being attached to the upper section of the outer sleeve.

A lower end region of the inner sleeve is fixed to the base plate, the outer sleeve or its upper and lower sections being movable up and down the inner sleeve to enable elevated adjustment of the first pair of upper and lower fence rails relative to the base plate. Connecting means are provided for releasably connecting the inner and outer sleeves together at a selected one of several vertical positions of the outer sleeve relative to the inner sleeve so as to fix the elevation of the first pair of upper and lower fence rails a selected distance above the base plate.

It is preferred that at least one of the first and second attaching means are configured so as to enable the first and second pairs of upper and lower fence rails to be detachably attached to the fence post at a selected angle relative to each other, that is, so that the first and second pair of upper and lower fence rails (or fencing sections) can be attached to the post out of alignment with one another as may be needed, for example, at a corner of a lot being fenced.

The apparatus can comprise the above-described fence post and first and second sections of wrought iron fencing, which are formed from the above-described first and second pairs of upper and lower fence rails.

Because of the above-described construction of the adjustable fence post, much of the fence can be prefabricated off-site, such as at a welding shop or manufacturing facility, at a lower cost than is possible for complete on-site construction of the fencing.

BRIEF DESCRIPTION OF THE DRAWINGS

The present invention can be more readily understood by a consideration of the following detailed description when taken in conjunction with the accompanying drawings, in which.

In the various FIGS. identical elements and features are given the same reference number.

DETAILED DESCRIPTION OF THE INVENTION

There is shown in FIGS. 1–5 a metal (e.g., a wrought iron) fence assembly 10 which comprises generally an adjustable fence post assembly or apparatus 12 and respective first and second sections 14 and 16 of metal fencing that are detachably attached to the fence post in a manner more particularly described below.

Figure 1:
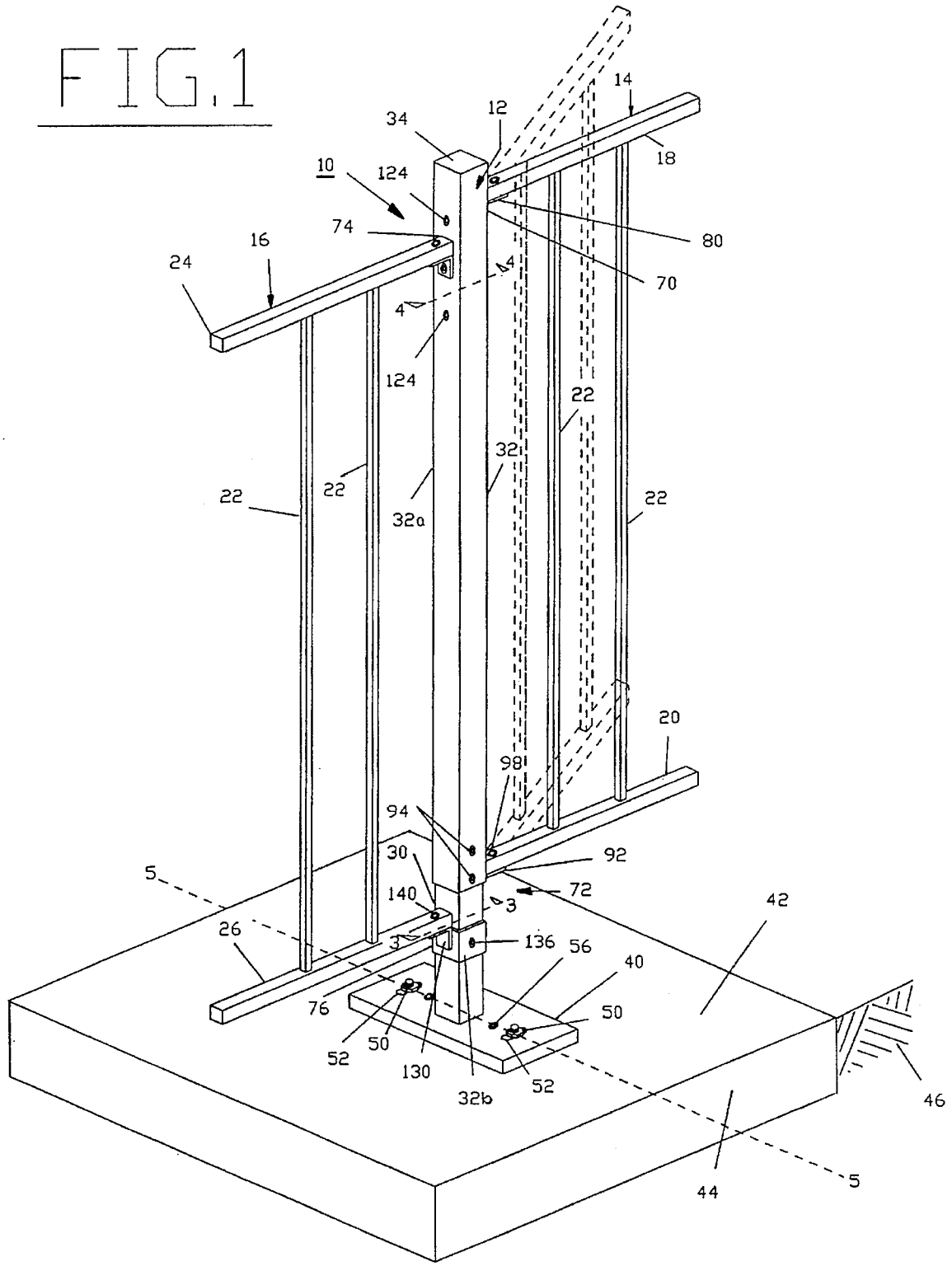
FIG. 1 is a partially cut-away perspective drawing of a metal, for example, a wrought iron, fence post having fence rails detachably attached thereto and a fence post mounting plate in accordance with a preferred embodiment of the invention, FIG. 1 showing the mounting of opposing pairs of upper and lower fence rails with their palings to the fence post and further showing the manner in which the fence post is adjustably mounted to a concrete pad in the ground.
Figure 2:
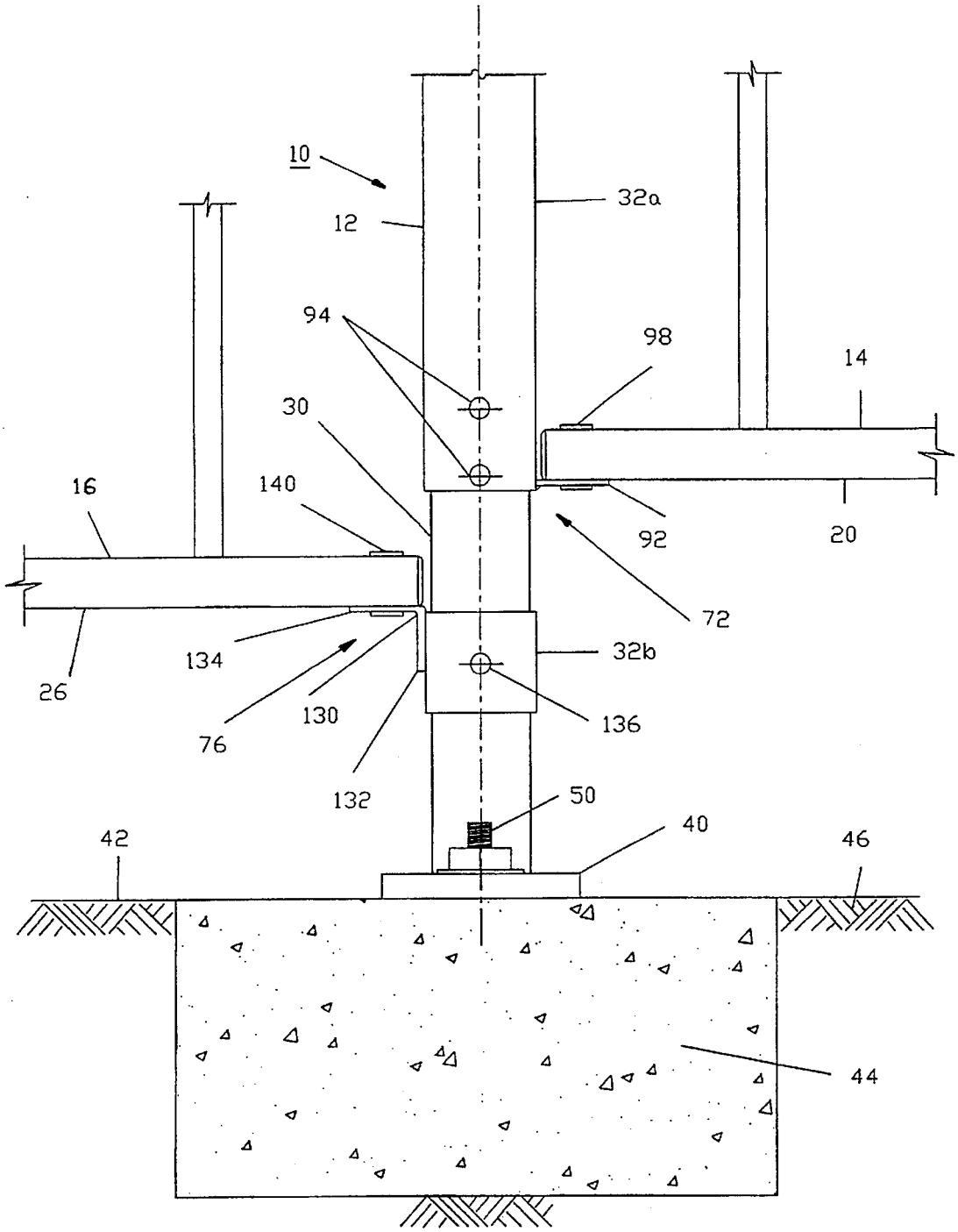
FIG. 2 is a front, vertical view of lower regions of the fence post of FIG. 1, showing the manner in which the pair of lower fence rails are mounted to the fence post in a vertically offset configuration.

First fence section 14, as best seen in FIG. 1, comprises a first upper fence rail 18 and a first lower fence rail 20, both of such rails being generally horizontal when attached to fence post 12. Vertically interconnecting first upper and lower rails 18 and 20 are a number of spaced apart palings 22, only two of which are shown. In a like manner, second fencing section 16 comprises respective second upper and lower fence rails 24 and 26 which are likewise vertically interconnected by a number of palings 22, only two of which are shown.

Fence post assembly 12 comprises an elongate, relatively slender but rigid metal inner sleeve or member 30 and a rigid metal outer sleeve or member 32 which is disposed or mounted closely around the inner sleeve in a vertical sliding relationship. For purposes that will become apparent, outer sleeve 32 can be considered as comprising a long upper section **32*a* having a closed upper end 34 (FIGS. 1 and 4) and a short lower section 32*b***.

A fence post mounting plate 40 is fixed to a lower end of post inner sleeve 30. Plate 40 is mounted to a mounting surface 42 (FIGS. 1–3 and 5) which may be the upper surface of a concrete pad or slab 44 that is set into a region 46 of the ground. Alternatively, surface 42 may be any surface to which plate 40 can be securely mounted.

Figure 5:
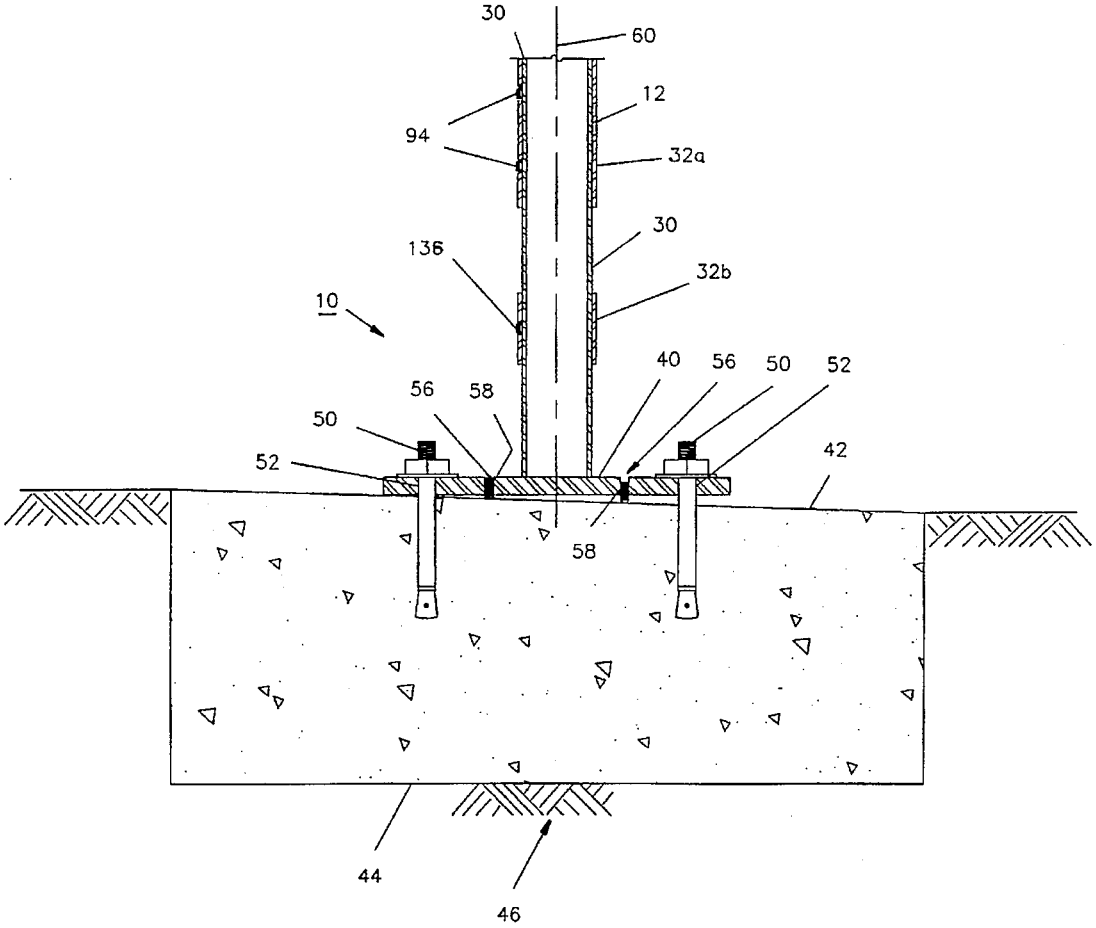
FIG. 5 is a vertical cross sectional drawing taken along line 5—5 of FIG. 1, showing the manner in which the fence post is adjustably mounted to a concrete pad in the ground.

A pair of spaced apart bolts 50, which pass through slotted openings 52 (FIG. 1 ) in plate 40, are used to mount the plate, and hence fence post assembly 12, to concrete pad 44. Slotted openings 52 permit base plate 40 and post 12 mounted thereto to be rotatably adjusted a small amount relative to pad 44, for example, to compensate for any fence misalignment. As shown in FIG. 5, bolts 50 extend into corresponding pad 44.

Two (or more) spaced apart leveling bolts 56 extend through threaded holes 58 in plate with the lower ends of the bolts in contact with mounting pad surface 42. By adjustment of leveling screws 56, plate 40 can be leveled upon an uneven surface 42 so that a vertical axis 60 of fence post assembly 12 is vertical.

First upper and lower attaching means 70 and 72, respectively, are provided for detachably attaching proximal ends of respective first upper and lower fence rails 18 and 20 to fence post 12, and second upper and lower attaching means 74 and 76, respectively, are provided for detachably attaching proximal ends of respective fence rails 24 and 26 to the fence post (FIGS. 1–4).

Figure 4:
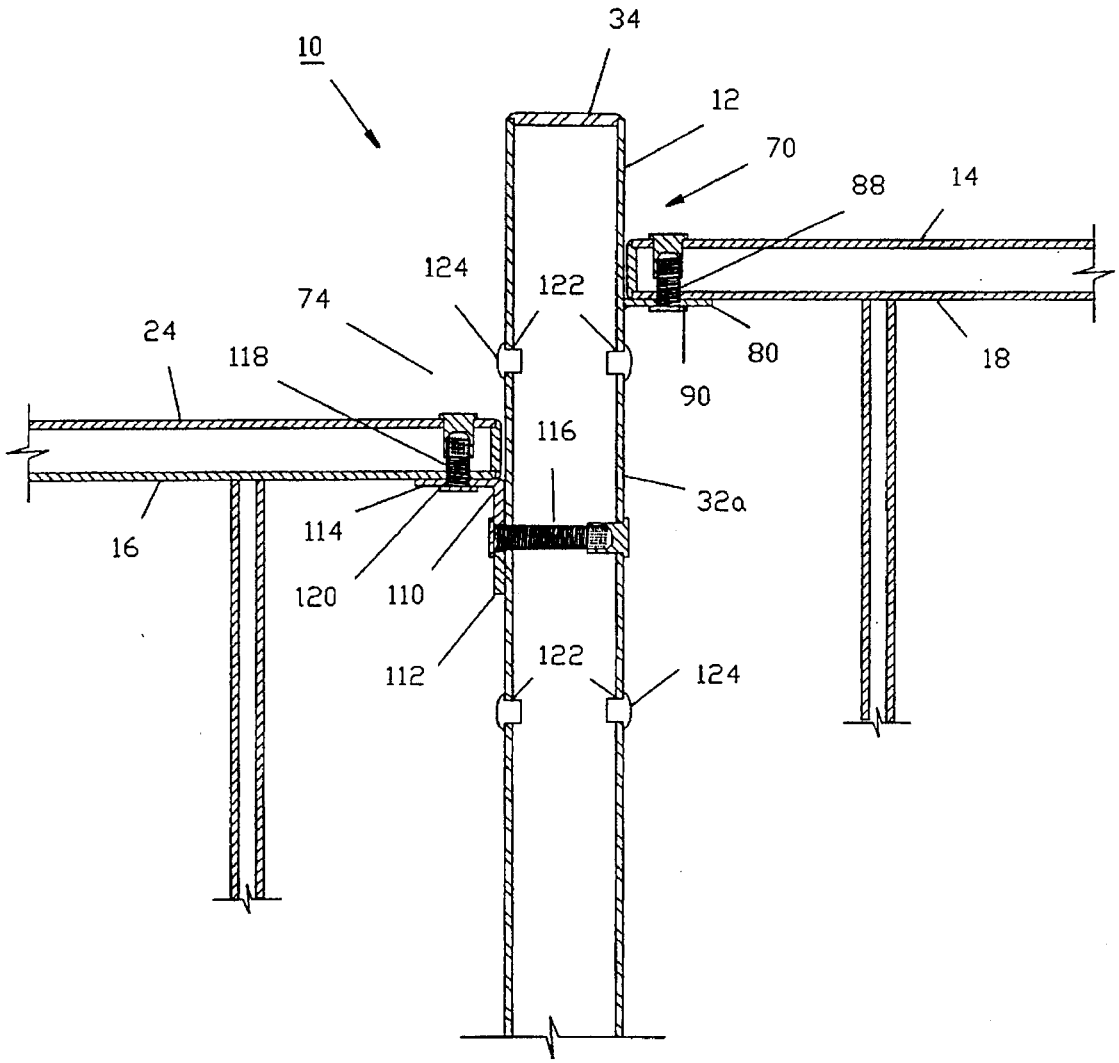
FIG. 4 is a vertical cross sectional drawing taken along line 4—4 of FIG. 1, showing the manner in which the vertically staggered pair of upper fence rails are mounted to an outer sleeve portion of the fence post.

As best seen in FIG. 4, first, upper attaching means 70 comprises a short section of metal attachment tab 80, which is welded at 90 degrees to an upper region of outer sleeve upper section **32*a*. The proximal end of upper rail 18 is detachably fastened to attachment tab 80 by a vertical bolt 88. Apertures 90 formed through attachment tab 80 receiving attachment bolt 88 are elongated in the axial direction of the rail to permit adjustable mounting of the rail to fence post outer sleeve section 32*a***.

Figure 3:
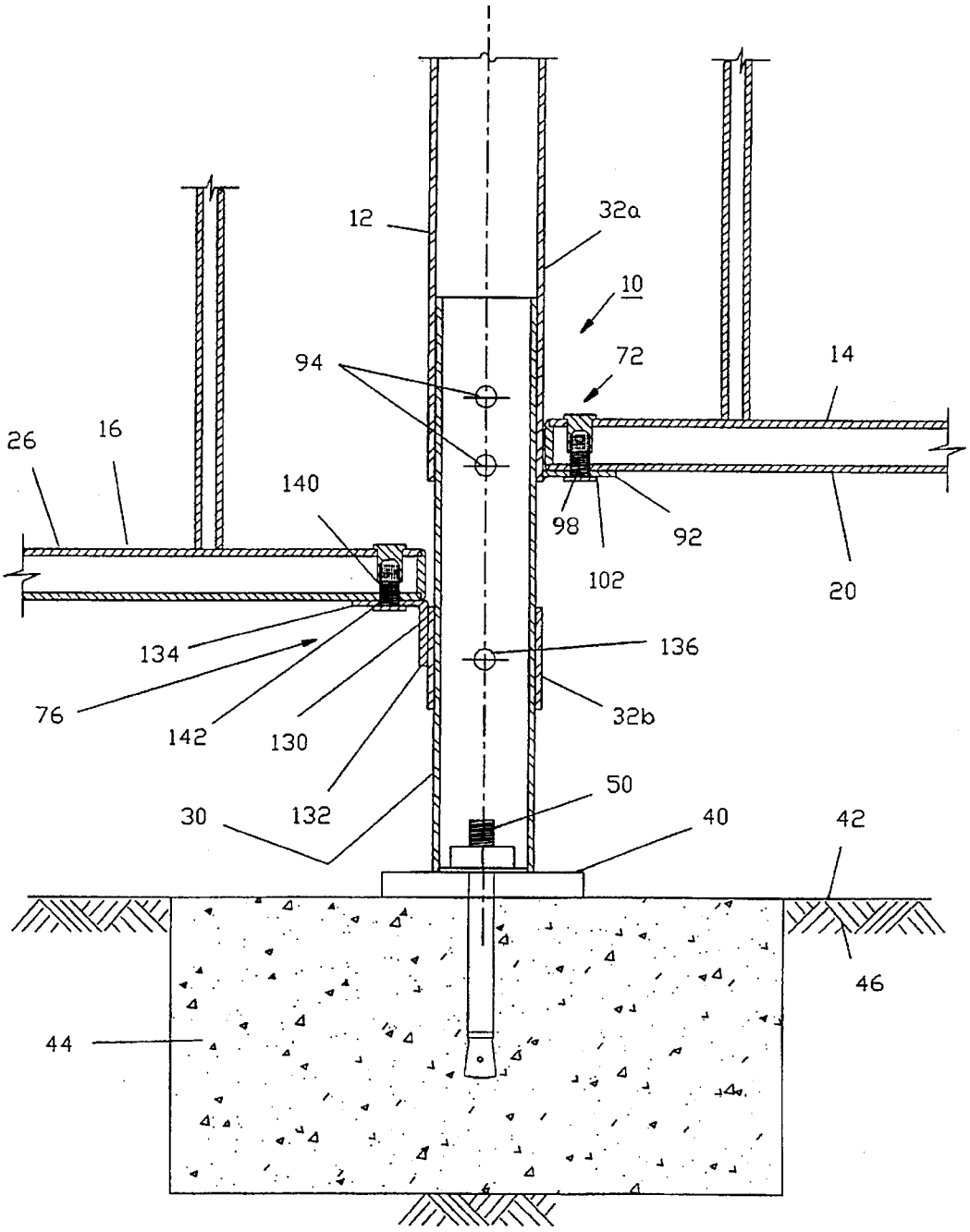
FIG. 3 is a vertical cross sectional drawing taken along line 3—3 of FIG. 1, showing the internal construction of the fence post and showing further details of the mounting of vertically staggered lower fence rails to the fence post.

In an identical manner, the proximal end of first lower rail 20 is detachably attached to a lower region of outer sleeve section **32*a* by an iron attachment tab 92 which forms part of first lower attachment means 72 (FIG. 3). Attachment tab 92 is welded to post 12. As shown, two set screws 94 function to secure inner and outer sleeves 30 and 32*a* together. A vertical bolt 98 detachably bolts the proximal end of lower rail 20 to the attachment tab 92 (and thereby to fence post 12). Slotted hole 102 formed through lower attachment tab 92 for receiving bolt 98 enables adjustable connection of the lower rail to attachment tab 92 in the manner described above for upper rail 18**.

Because of slotted holes 90 in upper rail 18 and slotted holes 102 in lower attachment tab 92, the rails, and hence the fence section 14 they comprise, can be pivoted (before tightening of respective bolts 88 and 98 which mount the rails to respective angles 80 and 92) about the bolts to a selected angle, as shown for one particular angle in phantom lines in FIG. 1.

Outer sleeve 12 is, as shown in FIG. 3, formed having a number of vertically spaced-apart set screw holes 94 which enable outer sleeve 12 to be secured to the inner sleeve 30 at various different elevations and which thereby enable outer sleeve **32*a* (with attached fence section 14) to be adjustable at different selected heights above base plate 40**, as may be needed or desired, for example, to accommodate the fence section to terrain slopes.

Second fencing section 16 is detachably attached to fence post assembly 12 in a manner similar to that described above for first fencing section 14. As best shown in FIG. 4, second, upper attaching means 74 comprises a short metal angle 110 having respective vertical and horizontal legs 112 and 114. A bolt 116 extending through angle lower leg 112 and outer sleeve upper section 32*a* attaches angle 110 to the outer sleeve. A bolt 118 vertically extending through angle horizontal leg 114 and the proximal end of second upper rail 24 detachably attaches the upper rail to fence post assembly 12. Preferably hole 120 formed in angle 110 for receiving bolt 118 is slotted in the manner and for the purpose above-described for attachment means 70.

As can be seen, outer sleeve upper section 32*a* is formed having a plurality of transverse holes 122 through which bolt 116 can be inserted to thereby selectively adjust the height of angle 110, and hence second upper rail 24, relative to angle 80 which is used (as above-described) to attach first upper rail 18 to the outer sleeve. Unused holes 122 are preferably closed by bolts 124.

Although for illustrative purposes FIG. 1 and 4 show second upper rail 24 attached to post assembly 12 at an elevation below first upper rail 18, this is not necessarily the case. It is, therefore, to be appreciated that in some or even all installations the two upper rails may need to be attached at the same elevation, in which case angle 110 is attached to outer sleeve section 32*a* with the same bolt 84 used for attaching angle 80.

When, however, as depicted in FIG. 1 and 4, second upper fence rail 24 is attached to outer sleeve section 32*a* at an elevation below that of first upper rail 18, second lower fence rail 26 is detachably attached to outer sleeve lower section 32*b*, which is installed over inner sleeve 30 below the lower end of outer sleeve upper section 32*a* (FIGS. 1–3 and 5). As is apparent from such FIGS., the use of short lower section 32*b* of the outer sleeve enables upper sleeve section 32*a* to terminate just below first lower rail 20. Thus, when rail sections 14 and 16 do not need to be staggered in elevation, outer sleeve upper section 32*a* can be positioned on inner sleeve 30 so that the fence sections are relatively close to base plate 40 and mounting surface 42, as may be desired in some instances. Accordingly, lower section 32*b* functions as a lower extension of upper section 32*a* when needed.

As best seen in FIG. 3, second, lower attachment means 76 comprises a metal angle 130 having a vertical leg 132 and a horizontal leg 134. Angle 130 is detachably attached to lower sleeve section 32*b* by a bolt 136 that extends through such sleeve section and an appropriate pair of holes 99 through inner sleeve 30. Thus bolt 136 also serves to bolt lower section 32*b* to inner sleeve 30.

A bolt 140 is used to detachably attach the proximal end of second lower rail 26 to horizontal leg 134 of angle 130, and hence to fence post 12. As in the case of upper rail 24, slotted holes 142 in rail 26 through which bolt 140 passes enable pivoting of the lower rail relative to post 12.

It will be appreciated that although FIGS. 1 through 4 show, for illustrative purposes, that first fence section 14 is elevated above second fence section 16, the installation of the fence sections can be such that the second section is elevated above the first fence section. Thus, either of the two fence sections 14 and 16 can easily be installed to fence post assembly 12 above the other, or both fence sections can be installed at the same elevation.

Although there has been described and illustrated a metal fence post with adjustable mounting for the fence rails or fence sections and for mounting the fence post to a concrete pad in accordance with the present invention for purposes of illustrating the manner in which the invention may be used to advantage, it is to be appreciated that the invention is not limited thereto. Therefore, any and all variations and modifications that may occur to those skilled in the computer printing and computer paper handling art are to be considered as being within the scope and spirit of the claims as appended hereto.

What is claimed is:

1. An adjustable fence post apparatus for metal fences, said apparatus comprising:

a. a rigid metal post comprising an inner sleeve and an outer sleeve;

b. a base plate having fixed thereto one end region of said post, said base plate being configured for enabling said post to be detachably attached to a mounting pad;

c. first means for detachably attaching a first pair of spaced apart upper and lower fence rails to a first side region of said outer sleeve of said post; and d. second means for detachably attaching a second pair of spaced apart upper and lower fence rails to a second side region of said post, said second attaching means enabling the second pair of fence rails to be detachably attached to said second side region of said post at least one different elevation from the elevation at which said first pair of upper and lower fence rails are attached to the post.

2. The adjustable fence post apparatus as claimed in claim 1, including leveling means for enabling said base plate to be leveled to the horizontal plane when the base plate is attached to a mounting pad the upper surface of which is not to the horizontal plane.

3. The adjustable fence post apparatus as claimed in claim 1, wherein said a lower end region of said inner sleeve is fixed to said base plate.

4. The adjustable fence post apparatus as claimed in claim 3, wherein said outer sleeve is vertically slidable relative to said inner sleeve, and means for releasably connecting said inner and outer sleeves together at a selected vertical position of said outer sleeve relative to said inner sleeve, the elevation of said first pair of upper and lower rails being thereby vertically adjustable relative to said base plate.

5. The adjustable fence post apparatus as claimed in claim 1, wherein at least one of said first and second attaching means enables said first and second pair of upper and lower rails to be detachably attached to said post at an angle other than 180 degrees relative to each other.

6. An adjustable fence post apparatus for wrought iron fences, said apparatus comprising:

a. a rigid metal post comprising an inner sleeve and an outer sleeve;

b. a base plate having fixed thereto one end region of said post, said base plate being configured for enabling said post to be detachably attached to a mounting pad;

c. first means for detachably attaching a first pair of spaced apart upper and lower fence rails to a first side region of said post, said first attaching means being mounted on said outer sleeve; and d. second means for detachably attaching a second pair of spaced apart upper and lower fence rails to a second, opposite side region of said post, said second attaching means enabling the second pair of fence rails to be detachably attached to said second side region of said post at a selected one of a plurality of different elevations relative to the elevation at which said first pair of upper and lower fence rails are attached to the post.

7. The adjustable fence post apparatus as claimed in claim 6, including leveling means for leveling said base plate when the base plate is attached to a mounting pad having an upper mounting surface which is not horizontal.

8. The adjustable fence post apparatus as claimed in claim 6, wherein said a lower end of said inner sleeve is fixed to said base plate.

9. The adjustable fence post apparatus as claimed in claim 8, wherein said outer sleeve is vertically slidable relative to said inner sleeve, and means for releasably connecting said inner and outer sleeves together at a selected one of a plurality of vertical positions of said outer sleeve relative to said inner sleeve, the elevation of said first pair of upper and lower rails being thereby vertically adjustable relative to said base plate.

10. The adjustable fence post apparatus as claimed in claim 6, wherein at least one of said first and second attaching means enables a corresponding one of said first and second pairs of upper and lower rails to be detachably attached to said post at a selected angle relative to other one of said pairs of upper and lower rails.

11. An adjustable fence post apparatus for wrought iron fences, said apparatus comprising:

a. a metal post;

b. a base plate having fixed thereto one end region of said post, said base plate being configured for enabling said post to be detachably attached to a mounting pad;

c. a first section of fencing comprising spaced apart first upper and lower fence rails and a number of fence palings connected between said upper and lower fence rails;

d. a second section of fencing comprising spaced apart second upper and lower fence rails and a number of fence palings connected between said upper and lower fence rails;

e. first means for detachably attaching said first section of fencing to a first side region of said post;

f. second means for detachably attaching said second section of fencing to a second side region of said post; and g. adjusting means for enabling the second section of fencing to be attached to said fence post at a selected one of a plurality of different elevations relative to the elevation at which said first section of fencing is attached to the post.

12. The adjustable fence post apparatus as claimed in claim 11, including leveling means for leveling said base plate when the base plate is attached to a mounting pad having an upper mounting surface which is not horizontal.

13. The adjustable fence post apparatus as claimed in claim 11, wherein said post includes telescoping inner and outer sleeves, and wherein said first attaching means attaches said first section of fencing to said outer sleeve.

14. The adjustable fence post apparatus as claimed in claim 13, wherein said a lower end of said inner sleeve is fixed to said base plate.

15. The adjustable fence post apparatus as claimed in claim 13, wherein said adjusting means include means for detachably connecting said inner and outer sleeves together at a selected one of a plurality of vertical positions of said outer sleeve relative to said inner sleeve, the elevation of first fencing section being thereby vertically adjustable relative to said base plate.

16. An adjustable fence post and fencing apparatus for wrought iron fences, said apparatus comprising:

a. a rigid metal post comprising an elongate inner sleeve, an elongate outer sleeve section and a short outer sleeve section, said outer sleeve sections being slidably disposed around said inner sleeve, and including means for detachably connecting the inner sleeve sections and said outer sleeve together at a selected one of a plurality of relative positions;

b. a base plate having fixed thereto a lower end of said inner sleeve, said base plate being configured for enabling said post to be detachably attached to a mounting pad;

c. a first section of fencing comprising spaced apart first upper and lower fence rails and a number of fence palings connected between said upper and lower fence rails;

d. a second section of fencing comprising spaced apart second upper and lower fence rails and a number of fence palings connected between said upper and lower fence rails;

e. first means for detachably attaching said first section of fencing to a first side region of said outer sleeve;

f. second means for detachably attaching said second section of fencing to a second side region of said elongate outer sleeve section and to said short outer sleeve section; and g. adjusting means for enabling the second section of fencing to be attached to said fence post at a selected one of a plurality of different elevations relative to the elevation at which said first section of fencing is attached to the post.

17. The apparatus as claimed in claim 16, including leveling means for leveling said base plate when the base plate is attached to a mounting pad having an upper mounting surface which is not horizontal.

18. The apparatus as claimed in claim 16, wherein at least one of said first and second attaching means enables a corresponding one of said first and second fencing sections to be detachably attached to said post at a variable angle relative to other one of said fencing section.

* * * * *